US010238566B2

(12) United States Patent
Heimbrock et al.

(10) Patent No.: US 10,238,566 B2
(45) Date of Patent: Mar. 26, 2019

(54) MATTRESS BLADDER BOOSTING DURING CHAIR EGRESS

(75) Inventors: Richard H. Heimbrock, Cincinnati, OH (US); Jonathan D. Turner, Dillsboro, IN (US); David W. Hornbach, Brookville, IN (US)

(73) Assignee: Hill-Rom Services, Inc., Batesville, IN (US)

( * ) Notice: Subject to any disclaimer, the term of this patent is extended or adjusted under 35 U.S.C. 154(b) by 1499 days.

(21) Appl. No.: 12/963,015

(22) Filed: Dec. 8, 2010

(65) Prior Publication Data

US 2012/0144588 A1 Jun. 14, 2012

(51) Int. Cl.

| | |
|---|---|
| ***A61G 7/16*** | (2006.01) |
| ***A61G 7/057*** | (2006.01) |
| ***A61G 5/14*** | (2006.01) |
| ***A61G 7/053*** | (2006.01) |
| *A61G 7/10* | (2006.01) |

(52) U.S. Cl.

CPC ..... *A61G 7/16* (2013.01); *A61G 5/14* (2013.01); *A61G 7/053* (2013.01); *A61G 7/05776* (2013.01); *A61G 7/05769* (2013.01); *A61G 7/1021* (2013.01); *A61G 2203/42* (2013.01)

(58) Field of Classification Search

CPC ..... A61G 7/053; A61G 7/05761; A61G 7/05769; A61G 7/05776; A61G 7/16; A61G 7/1021; A61G 5/14; A61G 2203/42

USPC ... 5/612, 613, 615, 710–713, 81.1 R, 83.1 R

See application file for complete search history.

(56) References Cited

U.S. PATENT DOCUMENTS

| | | | | |
|---|---|---|---|---|
| 4,017,118 | A * | 4/1977 | Cawley | 297/284.3 |
| 4,127,906 | A * | 12/1978 | Zur | A61G 7/015 297/DIG. 10 |
| 4,227,269 | A * | 10/1980 | Johnston | A61G 7/002 5/611 |
| 4,787,104 | A * | 11/1988 | Grantham | A61G 7/00 5/423 |
| 5,375,910 | A | 12/1994 | Murphy | |
| 5,630,238 | A | 5/1997 | Weismiller et al. | |
| 5,666,681 | A | 9/1997 | Meyer et al. | |
| 5,682,631 | A | 11/1997 | Weismiller et al. | |
| 5,692,256 | A | 12/1997 | Kramer et al. | |
| 5,715,548 | A | 2/1998 | Weismiller et al. | |
| 5,742,957 | A * | 4/1998 | Vanzant | 5/81.1 R |
| 5,745,937 | A | 5/1998 | Weismiller et al. | |
| 5,781,949 | A | 7/1998 | Weismiller et al. | |
| 5,970,789 | A | 10/1999 | Meyer et al. | |
| 6,008,598 | A * | 12/1999 | Luff et al. | 318/16 |
| 6,009,570 | A | 1/2000 | Hargest et al. | |

(Continued)

FOREIGN PATENT DOCUMENTS

| | | |
|---|---|---|
| EP | 1006977 | 6/2000 |

OTHER PUBLICATIONS

European Search Report for EP Application No. 11192329.8, dated Jun. 6, 2013, 8 pages.

*Primary Examiner* — Robert G Santos
*Assistant Examiner* — David R Hare
(74) *Attorney, Agent, or Firm* — Barnes & Thornburg LLP

(57) ABSTRACT

A patient support apparatus includes a mattress having a seat and a leg portion which are deflatable during movement of the patient support apparatus. The mattress includes a covering that is generally air impermeable so that a negative pressure can be developed inside of the covering.

18 Claims, 5 Drawing Sheets

(56) References Cited

U.S. PATENT DOCUMENTS 6,037,723 A * 3/2000 Shafer ..... A47C 27/082 318/6
6,079,065 A * 6/2000 Luff et al. ..... 5/618
6,151,739 A 11/2000 Meyer et al.
6,163,903 A 12/2000 Weismiller et al.
6,212,714 B1 4/2001 Allen et al.
6,351,863 B1 3/2002 Meyer et al.
6,496,993 B2 12/2002 Allen et al.
6,499,167 B1 12/2002 Ellis et al.
6,584,628 B1 7/2003 Kummer et al.
6,684,427 B2 2/2004 Allen et al.
6,823,549 B1 11/2004 Hampton et al.
6,848,135 B1 * 2/2005 Kohlman ..... 5/654
7,000,272 B2 2/2006 Allen et al.
7,086,107 B2 8/2006 Ellis et al.
7,216,384 B2 5/2007 Allen et al.
7,216,389 B2 5/2007 Ellis et al.
7,353,557 B2 4/2008 Ellis et al.
7,409,735 B2 8/2008 Kramer et al.
7,444,693 B2 11/2008 Russo et al.
7,469,436 B2 12/2008 Meyer et al.
7,520,006 B2 4/2009 Menkedick et al.
7,523,515 B2 4/2009 Allen et al.
7,600,817 B2 10/2009 Kramer et al.
7,669,263 B2 3/2010 Menkedick et al.
7,685,664 B2 3/2010 Stolpmann et al.
7,784,128 B2 * 8/2010 Kramer ..... 5/624
7,802,332 B2 * 9/2010 Kummer et al. ..... 5/615
7,905,306 B2 3/2011 Kramer et al.
7,937,791 B2 5/2011 Meyer et al.
7,975,335 B2 7/2011 O'Keefe et al.
8,328,283 B2 12/2012 Kramer et al.
2004/0158923 A1 8/2004 Perez et al.
2005/0200180 A1 9/2005 Guyton et al.
2006/0150321 A1 * 7/2006 Brockman et al. ..... 5/81.1 R
2007/0266499 A1 * 11/2007 O'Keefe et al. ..... 5/713
2007/0289067 A1 12/2007 Buchanan et al.
2009/0308491 A1 12/2009 Wang
2010/0132116 A1 6/2010 Stacy et al.
2011/0131720 A1 6/2011 Dean
2011/0163575 A1 7/2011 Kramer et al.

* cited by examiner

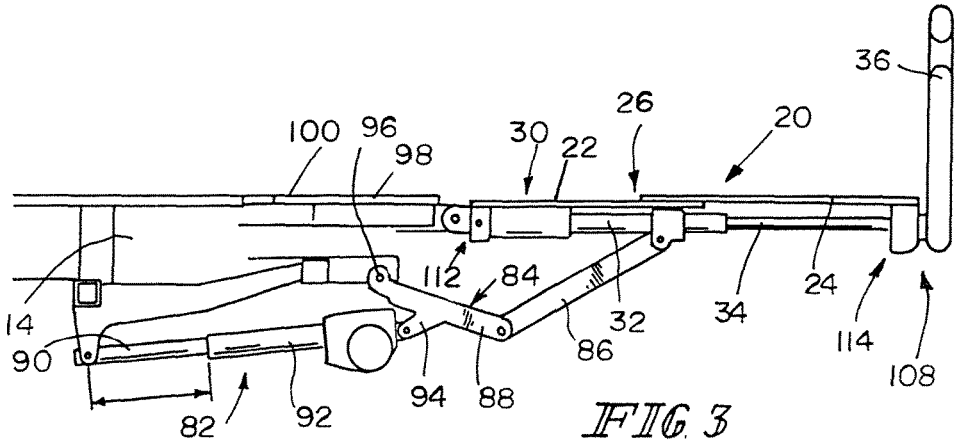
FIG. 3
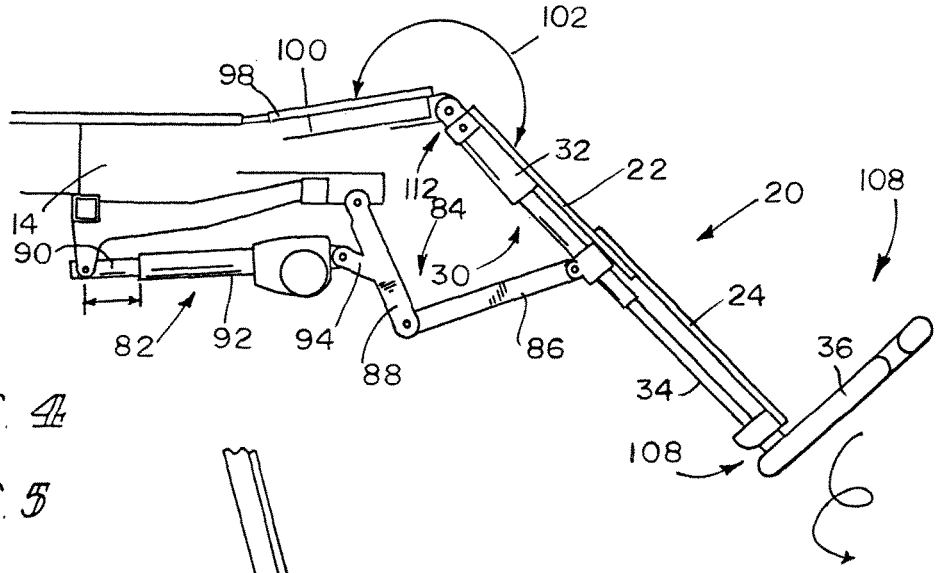
FIG. 4
FIG. 5
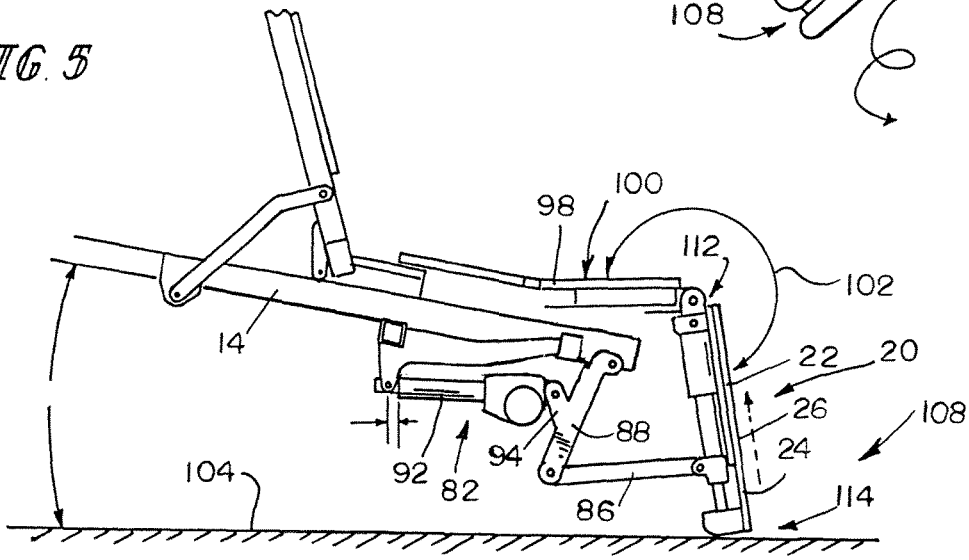

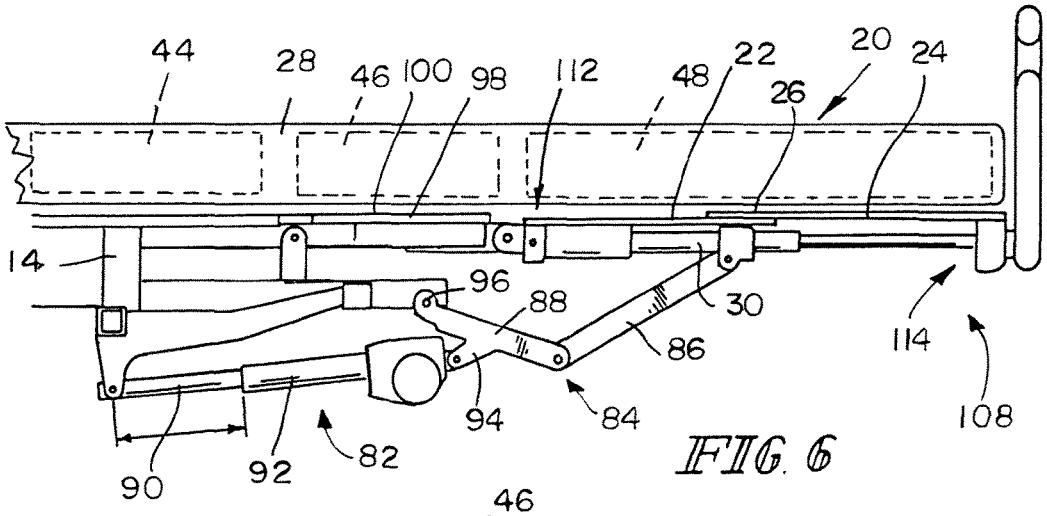
FIG. 6
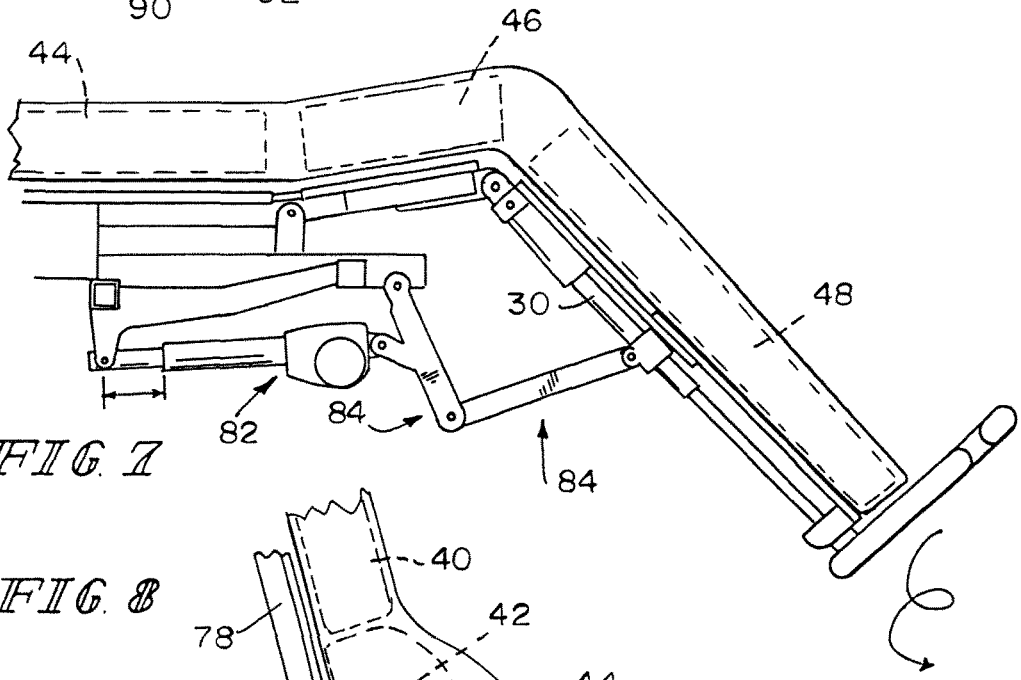
FIG. 7
FIG. 8
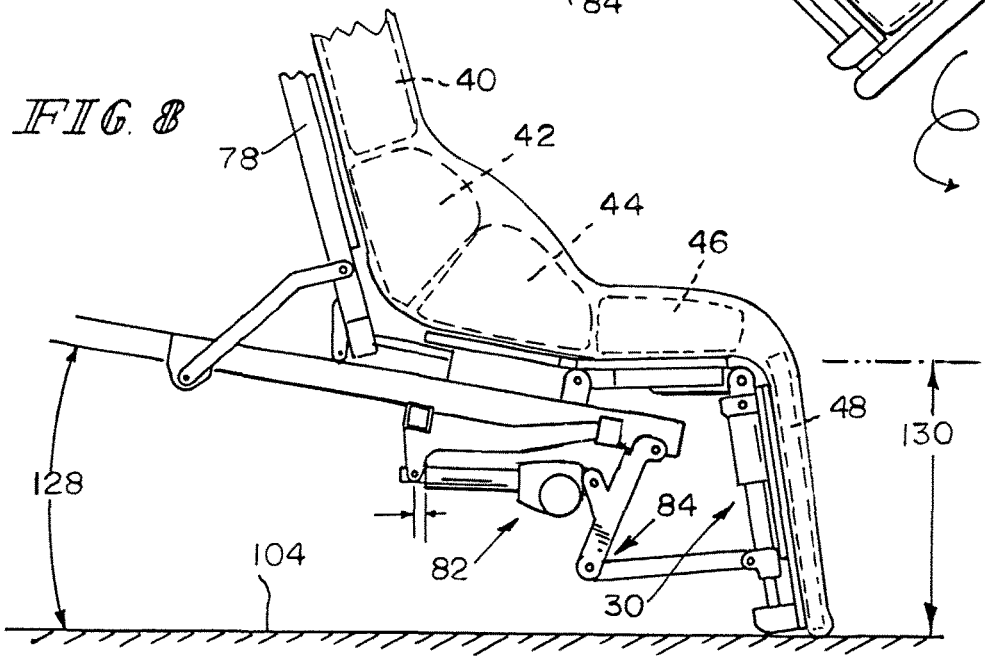

MATTRESS BLADDER BOOSTING DURING CHAIR EGRESS

BACKGROUND

The present disclosure is related to patient support apparatuses including inflatable mattresses. More specifically, the present disclosure is related to a patient support apparatus having an inflatable mattress that increases in size to lift a patient during egress from a foot end of a patient support apparatus.

Patient support apparatuses, such as hospital beds, for example, may include deck sections that are expandable or retractable to vary the size of the deck section. For example, a patient support apparatus may include a foot deck section to support the lower legs with the foot deck section being extendable or retractable to act as a foot prop to support the foot of a patient on the patient support apparatus. In patient support apparatuses that move to a chair egress position, such as the Hill-Rom® TotalCare® bed, the foot deck section may retract to prevent interference with the floor when the foot deck section is lowered to a generally vertical position.

When a hospital bed moves to a chair egress position, the patient egresses by placing their feet on the floor and standing. In lift chairs of the type used in the home for the elderly, the seat section is moved vertically and forwardly to assist an occupant in standing. In some cases, the entire chair is supported from a base frame and the chair moves upwardly relative to the base, rotating to move the back portion of the seat higher. In patient support apparatuses that move from a horizontal bed position to a chair egress position, the lifting of the seat section is hindered by the risk of tipping of the patient support apparatus if the weight of the patient egressing creates too great of a moment about the foot end casters.

SUMMARY

The present application discloses one or more of the features recited in the appended claims and/or the following features which, alone or in any combination, may comprise patentable subject matter.

According to a first aspect of the present disclosure a patient support apparatus includes a lower frame, an upper frame, a deck supported on the upper frame, an inflatable support structure supported on the deck, an air system, and a control system. The upper frame is movable relative to the lower frame. The deck includes at least a head deck section, a seat deck section, and a foot deck section. The inflatable support structure includes at least a head support section, a seat support section, and a foot support section. Each of the head support section, seat support section and foot support section includes an inflatable bladder. The inflatable bladders in the head support section and seat support section are inflatable between a support mode and an egress mode. The inflatable bladder of the foot section is deflatable between a support mode and an egress mode. The air system includes a source of pressurized air, an air distribution assembly. The control system includes a controller to control the flow of air from the source of pressurized air through the air distribution system to the inflatable support structure. The controller also coordinates the inflation of the inflatable bladders with movement of the bed between a bed position and chair egress position so that the inflatable bladders of the head support section, seat support section, and foot support section will only transition to the egress mode when the patient support apparatus is in the egress mode.

The inflatable support structure may further include a head egress bladder positioned in the head support section of the inflatable support structure. The head egress bladder may be normally deflated and selectively inflated to assist a patient in egressing from the foot end of the bed. The egress bladder positioned in the head support section may be positioned in the area of the head support section that corresponds to the lumbar region of a patient's back.

The inflatable support structure may further include a seat egress bladder positioned in the seat support section of the inflatable support structure. The seat egress bladder may be normally deflated and selectively inflated to assist a patient in egressing from the foot end of the bed.

When the inflatable support structure further includes a head egress bladder positioned in an area of the head support section of the inflatable support structure that corresponds to the lumbar area of a patient's back, the head egress bladder and seat egress bladder may each be normally deflated and each being independently selectively inflated to assist a patient in egressing from the foot end of the bed.

The control system may further include a user interface having a first user input device that permits a user to selectively inflate the head egress bladder. A second user input may permit a user to selectively inflate the seat egress bladder.

The controller may detect the position of the deck of the patient support apparatus. The controller may prevent inflation of the head egress bladder or seat egress bladder if the patient support apparatus is not in a chair egress position.

According to another aspect of the present disclosure, a patient support apparatus includes a deck, an inflatable support structure supported on the deck, and a control system. The deck includes at least a head deck section, a seat deck section, and a foot deck section the deck movable between a horizontal bed position for supporting a patient in a lying position to a chair egress position for supporting a patient in a sitting position. The inflatable support structure includes a first egress bladder and a second egress bladder, the first and second egress each being inflatable to enlarge a portion of the inflatable support structure to provide support to a patient during egress from a foot end of the patient support. The control system controls movement of the deck and inflation of the first and second egress bladders.

The foot deck section may be movable to a generally vertical position when the deck is in the chair egress position. The inflatable support structure may include at least one foot section bladder supporting a portion of a patient supported on the foot section, the control system deflating the foot section bladder when the deck is in the chair egress position.

The control system may include a user interface including a plurality of user input devices that permit a user to selectively inflate the first and second egress bladders.

The control system may monitor the position of the deck section and prevent inflation of the egress bladders if the deck is not in a chair egress position.

The first and second egress bladders may be normally deflated. The control system may monitor the position of the deck section and prevent inflation of the egress bladders if the deck is not in a chair egress position.

The control system may include a processor and a memory device, the processor utilizing instructions from the memory device to control the inflation and deflation of the first and second egress bladders. The first and second egress bladders may be inflated when the patient support apparatus reaches a chair egress position.

A user may actuate a user input device associated with a chair egress function and the control system moves the patient support apparatus to the chair egress position, selectively inflates the first and second egress bladder and selectively deflates other bladders in the inflatable support structure.

In some embodiments, the first and second egress bladders are normally inflated to a support pressure and the control system is operable to inflate the bladders to an egress pressure higher than the support pressure, the bladders expanding when inflated to the egress pressure.

Additional features, which alone or in combination with any other feature(s), including those listed above and those listed in the claims, may comprise patentable subject matter and will become apparent to those skilled in the art upon consideration of the following detailed description of illustrative embodiments exemplifying the best mode of carrying out the invention as presently perceived.

BRIEF DESCRIPTION OF THE DRAWINGS

The detailed description particularly refers to the accompanying figures, in which:

FIG. 3 is a side view of a portion of the patient support apparatus of FIG. 1 with the mattress omitted;

FIG. 4 is view similar to FIG. 3 with the foot deck section partially lowered and partially retracted;

FIG. 5 is view similar to FIGS. 2 and 3 with the foot deck section lowered and retracted, FIG. 6 is a view similar to FIG. 3 with a mattress present;

FIG. 7 is a view similar to FIG. 4 with a mattress present, the portion of the mattress positioned on a foot deck section of the patient support apparatus being partially deflated;

FIG. 8 is a view similar to FIG. 5, with a bladder positioned in the seat and a bladder in the lumbar region of the head section inflated to an egress position and the bladders in the thigh and leg portions of the mattress in a state of deflation.

DETAILED DESCRIPTION OF THE DRAWINGS

Figure 1:
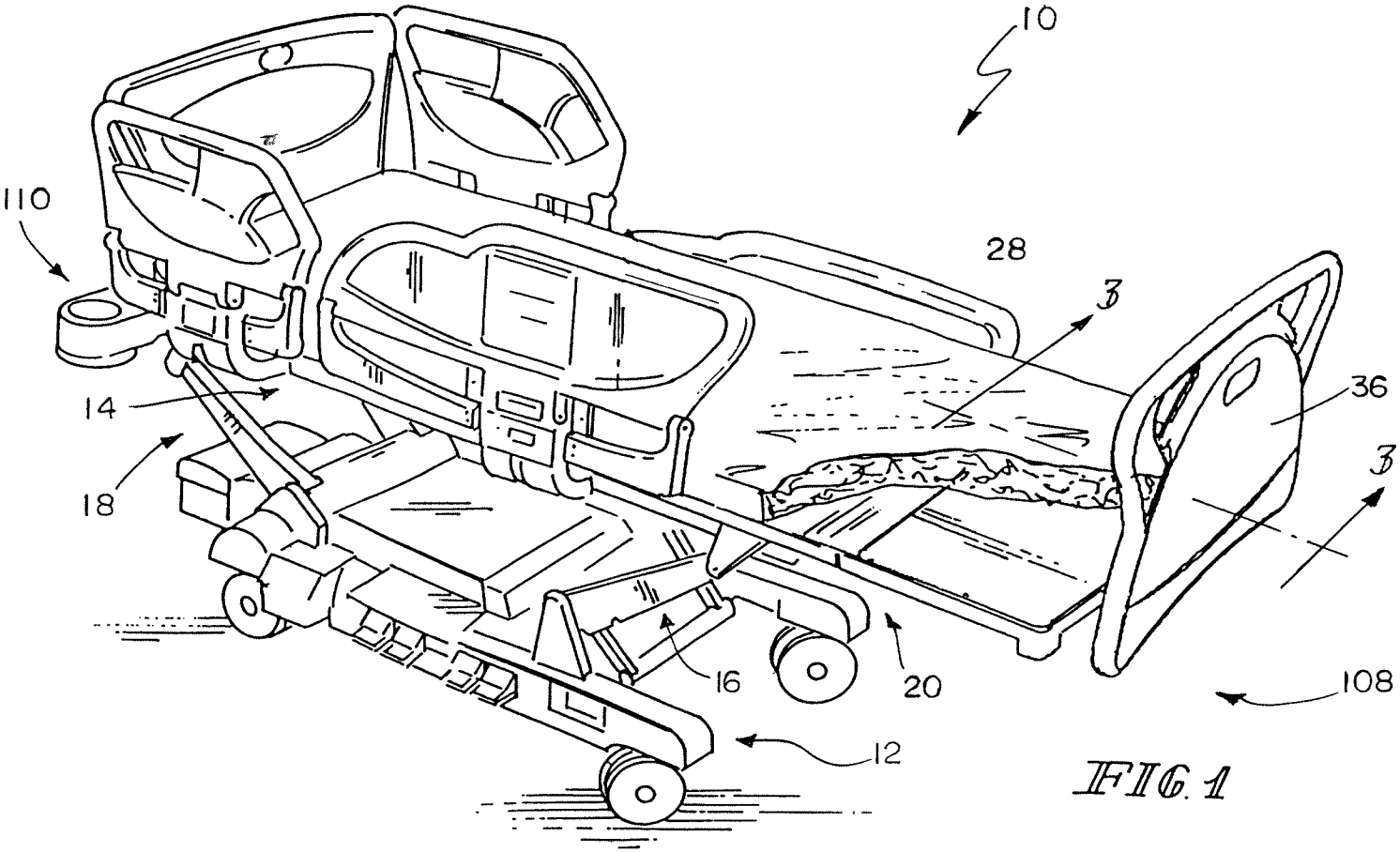
FIG. 1 is a perspective view of a patient support apparatus including a foot deck section that is extendable and retractable, the patient support apparatus movable to a chair egress position.

A patient support apparatus, illustratively embodied as a hospital bed 10 shown in FIG. 1, includes a lower frame 12 and an upper frame 14 movable relative to the lower frame 12. The upper frame 14 is supported on two pairs of lift arms 16 and 18, respectively. The lift arms 16 are positioned generally at a foot end 108 of the lower frame 12 and the lift arms 18 are positioned generally at a head end 110 of the lower frame 12. Reference to the foot end 108 and the head end 110 of the patient support apparatus 10 is intended to provide an orientation reference and does not refer to any specific surface or element of the patient support apparatus 10. The hospital bed 10 of FIG. 1 is movable from a horizontal bed position as shown in FIG. 1 to a chair egress position in which the foot deck section 20 of the hospital bed 10 is lowered to a generally vertical position as shown in FIG. 5. A removable footboard 36 is positioned on the foot deck section 20. A patient supported on the hospital bed 10 may egress or exit the hospital bed 10 from the foot end 108 of the hospital bed 10 in a seated position.

As shown in FIGS. 3-5, a foot deck section 20 of the patient support apparatus 10 is supported on the upper frame 14 and includes a base 22 and an extender 24 movable relative to the base 22 to vary the length of the foot deck section 20. The foot deck section 20 defines a support surface 26 which supports at least a portion of an inflatable support structure illustratively embodied as a mattress 28. The support surface 26 is variable in size and increases in size as the extender 24 moves relative to the base 22 to increase the length of the foot deck section 20. The extender 24 is supported from the base 22 and movable relative to base 22 between a fully extended position as shown in FIG. 3 and a retracted position as shown in FIG. 5.

Referring now to FIG. 3, the foot deck section 20 changes in length when acted on by an actuator 30 including a body 32 that is connected at a first end 112 to the base 22 of the foot deck section 20 and a rod 34 that moves relative to the body 32 of the actuator 30. A second end 114 of the actuator 30 is connected to the extender 24. The rod 34 of the actuator 30 extends and retracts relative to the body 32 to vary the length of the foot deck section 20 and the size of the support surface 26.

Extension and retraction of the foot deck section 20 may be used to modify the length of the hospital bed 10 to accommodate patients of different heights, or may be used to retract the foot deck section 20 when the foot deck section 20 is moved to a generally vertical position as shown in FIG. 5. The foot deck section 20 is supported on the upper frame 14 and pivotal relative to the upper frame 14. A linear actuator 82 rotates a crank 84 which supports the foot deck section 20 through an arm 86 which is pivotally coupled to the foot deck section 20 and a link 88 of the crank 84. The linear actuator 82 includes a rod 90 which extends and retracts relative to a body 92, with the actuator 82 acting on a link 94 of the crank 84 which causes the crank to rotate about an axis 96. Operation of the linear actuator 82 causes the foot deck section 20 to move relative to a thigh deck section 98 such that a surface 100 of the thigh deck section 98 and the surface 26 of the foot deck section 20 form a variable angle 102. The angle 102 between surface 26 and surface 100 is variable a straight angle being formed between the surface 26 and 100 when the foot deck section 20 is in a position to support a patient in a supine position on the hospital bed 10. As shown in FIG. 5, the angle 102 may be as great as approximately 270° when the foot deck section 20 is lowered to position the hospital bed 10 in the chair egress position. In the chair egress position shown in FIG. 4, the foot deck section 20 is fully retracted to reduce the height 130 of the thigh deck section 98 from the floor 104 when the upper frame 14 is lowered to the chair egress position.

The upper frame 14 is tiltable relative to the floor 104 to increase form an angle 128 of about 97°. In this attitude, the thigh deck section 98 is positioned approximately horizontally as shown in FIG. 4 to form the chair egress position. With the foot deck section 20 fully retracted, the height 130 is reduced to provide a position for a patient to egress from the foot end 108 of the hospital bed 10.

Figure 2:
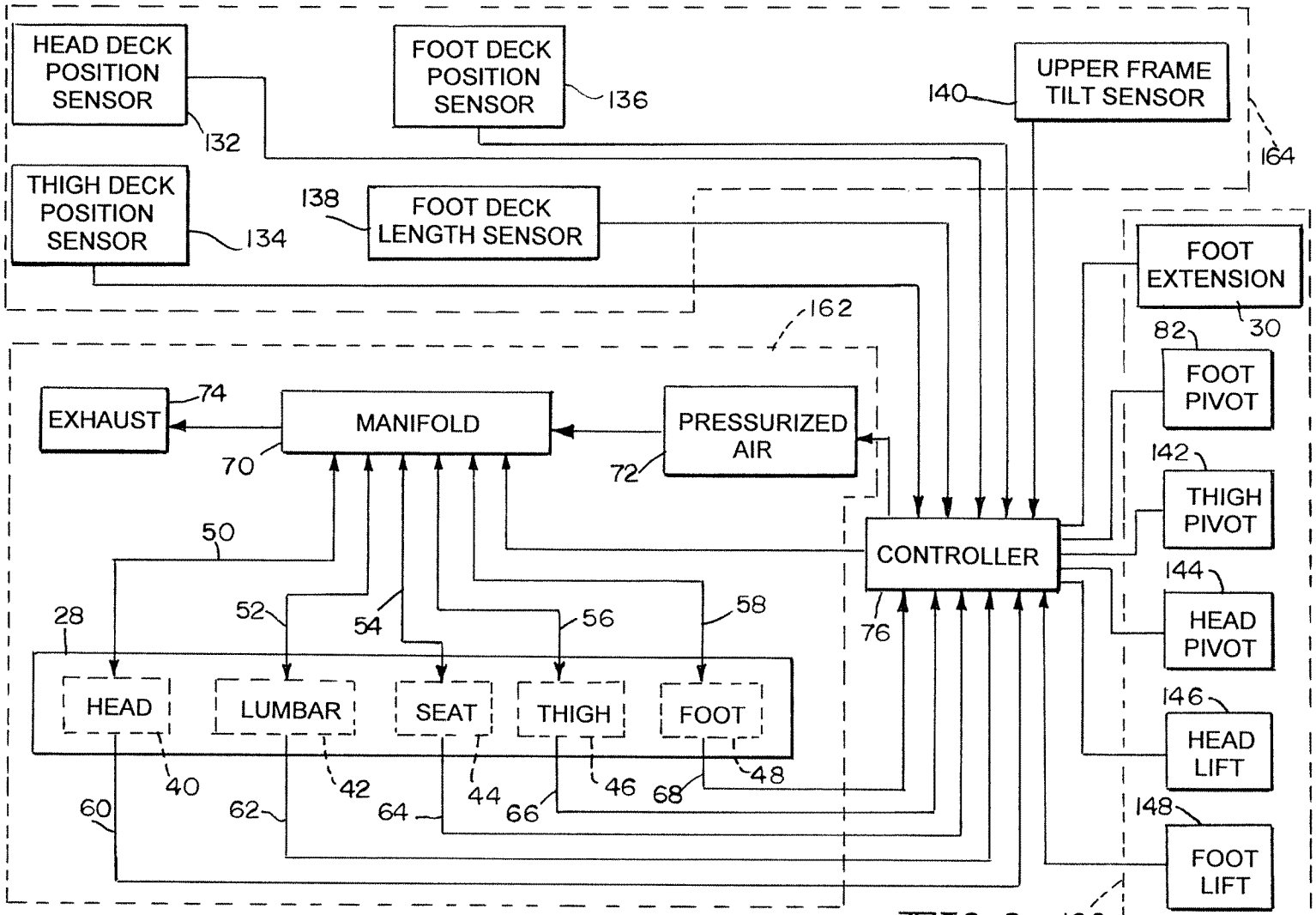
FIG. 2 is a block diagram of the mattress and associated control structures of a mattress patient support apparatus of FIG. 1.
Figure 9:
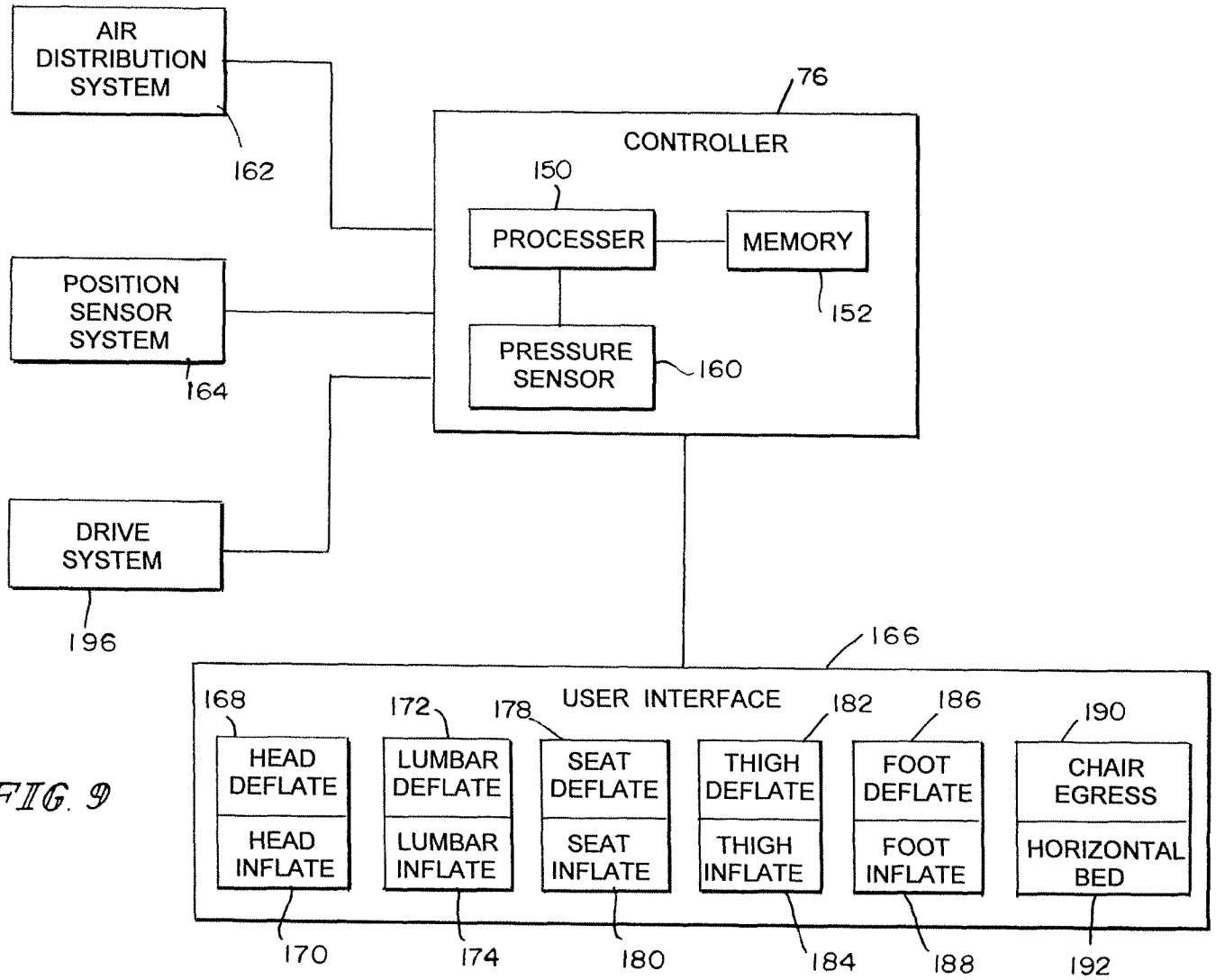
FIG. 9 is a block diagram of a portion of a control system of the patient support apparatus of FIG. 1.

While the foregoing discussion describes the movement of various structures of the hospital bed 10, the mattress 28 of the hospital bed 10 also changes configuration when the hospital bed 10 is in the chair egress position to assist a patient in exiting the foot end 108 of the bed 10. Referring to FIG. 2, an air distribution system 162 that operates the mattress 28 is shown diagrammatically to include a head bladder 40, a lumbar bladder 42, a seat bladder 44, a thigh bladder 46 and a foot bladder 48. In the illustrative embodiment, each of the bladders 40, 42, 44, 46, and 48 are shown as a single bladder. In some embodiments, each of the bladders 40, 42, 44, 46, and 48 may include multiple chambers interconnected by a conduit. Each of the bladders 40, 42, 44, 46, and 48 is connected to a manifold 70 by respective conduits 50, 52, 54, 56, and 58. Valves (not shown) of the manifold 70 control the flow of air between the bladders 40, 42, 44, 46, and 48 and a pressurized air source 72. In addition, the manifold 70 is operable to close the valves to maintain the pressure in the bladders 40, 42, 44, 46, and 48. The manifold 70 may also selectively control venting of the bladders 40, 42, 44, 46, and 48 to an exhaust 74. In some embodiments, the bladders 42, 44, 46, and 48 could actually be layered into two separate bladders with one or the other of a top or bottom bladder providing support and the other layer being inflatable to assist with egress. The egress bladders assist bladders could also be separate from the mattress 28 and positioned between the mattress 28 and the deck sections 20, 78, and 98.

The operation of the air distribution system 162 including the valves in the manifold 70 is controlled by a controller 76 which controls operation of the manifold 70 and source of pressurized air 72 to control the pressure in the bladders 40, 42, 44, 46, and 48. Each of the bladders 40, 42, 44, 46, and 48 is connected to a respective conduit 60, 62, 64, 66, and 68, each of which is connected to a respective pressure sensor 160 of the controller 76. The controller 76 monitors the pressures in the respective bladders 40, 42, 44, 46, and 48 and determines an appropriate pressure in each bladder 40, 42, 44, 46, and 48 based on the position of the various sections of the hospital bed 10.

In the illustrative embodiment, a drive system 196 of the hospital bed 10 includes the foot extension actuator 30, the foot pivot actuator 82, a thigh section pivot actuator 142, a head pivot actuator 144, a head lift actuator 146, and a foot lift actuator 148. The head lift actuator 146 drives the lift arms 18 and the foot lift actuator drives the lift arms 16. The head lift actuator 146 and foot lift actuator 148 cause the upper frame 14 to move relative to the lower frame 12 and control the angle 128 of tilt of the upper frame 14.

The controller 76 receives signals indicative of the position of the various components of the bed 10 from respective position sensors of a position sensor system 164 and controls the actuators 30, 82, 142, 144, 146, and 148. For example, the hospital bed includes a head deck section 78 that is movable relative to the upper frame 14. A head deck position sensor 132 monitors the position of the head deck section 78 relative to the upper frame 14. Similarly, the position of the thigh deck section 98 relative to the upper frame 14 is monitored by a thigh deck position sensor 134. The position of the foot deck section 20 relative to the upper frame 14 is monitored by a foot deck position sensor 136 while the length of the foot deck section 20 is monitored by a foot deck section length sensor 138. The angle of tilt 128 of the upper frame 14 is monitored by an upper frame tilt angle sensor 140. In the illustrative embodiment, the sensors 132, 134, 136, 138, and 140 are embodied as potentiometers coupled to the drives that control the motion of the various components of the bed 10. Illustratively, the upper frame tilt angle sensor 140 comprises the potentiometers in both the head lift actuator 146 and foot lift actuator 148. The output of the potentiometers in each of the head lift actuator 146 and foot lift actuator 148 are compared to determine the angle of tilt of the upper frame 14. The extension of the drives is measured by the potentiometers and the length of the drives is considered by the controller 70 to determine the various positions. In other embodiments, some of the sensors may include potentiometers that include linkages that directly measure the difference in angles between components of the bed 10. In some embodiments, some of the sensors may be accelerometers that measure the position of components relative to gravity.

When the bed 10 moves to the chair egress position, the seat bladder 44 and the lumbar bladder 42 are inflated as shown in FIG. 8. The seat bladder 44 and lumbar bladder 42 cooperate to provide support structure that urges against the buttocks and lower back of an occupant of the bed 10 to assist in lifting the occupant out of the bed 10. The controller 76 may also cause the thigh bladder 46 and foot bladder 48 to deflate to reduce the interference of the respective sections of the mattress 28 with the patient during egress. Inflation of the seat bladder 44 and the thigh bladder 46 may be controlled to gently lift the patient during egress. In some embodiments, the head section bladder 40 may also inflate to assist the occupant out of the foot end 108 of the hospital bed 10 or provide support to the back of the patient during egress. The controller 76 may include a processor 150 and a memory device 152 that stores instructions used by the processor 150 the processor 150 may consider information gathered from the pressure sensors 160, the air distribution system 162 and the position sensor system 164 to determine when to inflate and deflate the bladders 40, 42, 44, 46, and 48. The controller 76 may also act on information provided by a user interface 166 to control the air distribution system 162 based on inputs from a user. For example, the user interface includes a user input device 168 that is indicative that a user wishes to deflate the head bladder 40. A user input device 170 corresponds to inflation of the head bladder 40. Similarly, a user input device 172 provide a signal to the controller 76 that the lumbar bladder 42 is to be deflated while a user input device 174 provides a signal indicative of a user's desire to inflate the lumbar bladder 42. User input devices 178, 182, and 186 provide an indication that the respective seat bladder 44, thigh bladder 46, and foot bladder 48 are to be deflated. User input devices 180, 184, and 188 provide an indication that the respective seat bladder 44, thigh bladder 46, and foot bladder 48 are to be inflated.

The user interface 166 also includes a user input device 190 which allows a user to cause the bed 10 to move to the chair egress position with the controller automatically controlling the inflation and deflation of the bladders. Another user input device 192 is actuated by a user to move the bed 10 to the horizontal bed position with the controller 76 automatically controlling the inflation and deflation of the bladders. The movement of the bed 10 to the chair egress position may include the movement of the upper frame 14 to a tilt position as shown in Fig.

The processor 76 may use the instructions in the memory device 152 to automatically control the pressure in the various bladders 40, 42, 44, 46, and 48 or may rely on the input devices 168, 170, 172, 174, 178, 180, 182, 184, 186, and 188 to cause the bladders 40, 42, 44, 46, and 48 to inflate and deflate. The processor 76 may also use logic that combines the signals from the user input devices 168, 170, 172, 174, 178, 180, 182, 184, 186, and 188, position sensors 30, 82, 142, 144, 146, 148, and pressure sensors 160 to determine the appropriate operation of the air distribution system 162. For example, certain bladders 40, 42, 44, 46, and 48 may only be inflated or deflated under certain conditions and the pressure in the bladders 40, 42, 44, 46, and 48 may be limited based on a specific position of one portion of the bed 10. If, for example, the bed 10 is not in a full chair egress position as shown in FIG. 8, the seat bladder 44 may not be permitted to inflate to prevent the possibility for an excessive pressure to be used while the patient supported on the bed 10 is in a supine position.

The head bladder 40, lumbar bladder 42, and seat bladder 44 are illustratively used to support a patient in a supine position with a support pressure. The bladders 40, 42, and 44 are expandable when the pressure in the bladders 40, 42, and 44 exceeds a normal support pressure and rises to an egress pressure. In other embodiments, there may be a separately controllable bladder placed adjacent to each of the head bladder 40, lumbar bladder 42, and seat bladder 44 respectively with the separate head bladder 40', lumbar bladder 42', and seat bladder 44' being normally deflated while the head bladder 40, lumbar bladder 42, and seat bladder 44 are maintained at a support pressure. The separate head bladder 40', lumbar bladder 42', and seat bladder 44' may be inflated to provide additional support for an occupant to egress the bed 10 when the bed 10 is in the chair egress position.

Alternatively, the head bladder 40, lumbar bladder 42, and seat bladder 44 may be normally deflated and contained within the mattress 28 with foam providing support for the patient in the horizontal bed position. The head bladder 40, lumbar bladder 42, and seat bladder 44 may then be selectively inflated to provide additional support to a person exiting from the bed 10.

Although certain illustrative embodiments have been described in detail above, variations and modifications exist within the scope and spirit of this disclosure as described and as defined in the following claims.

The invention claimed is:

1. A patient support apparatus comprising a lower frame, an upper frame movable relative to the lower frame, a deck supported on the upper frame, the deck including at least a head deck section, a seat deck section, and a foot deck section, a horizontal bed position for supporting a patient in a lying position in which the head deck section is lowered and the foot deck section is raised, a chair egress position for supporting the patient in a sitting position in which the head deck section is raised and the foot deck section is lowered, an inflatable support structure supported on the deck, the inflatable support structure including at least a head support section, a lumbar support section, a seat support section, and a foot support section, each of the head support section, the lumbar support section, seat support section, and foot support section each including an inflatable bladder, the inflatable bladders in the lumbar support section and seat support section operable to be inflated from a support pressure when the deck is positioned in the horizontal bed position to an egress pressure when the deck is positioned in the chair egress position, wherein in the horizontal bed position the lumbar support section and the seat support section bladders are configured to provide substantially planar support surfaces at a support pressure and in the chair egress position the lumbar support section and seat support section bladders are inflated to an egress pressure that is greater than the support pressure so that the lumbar support section and seat support section bladders are expanded to provide a convex support surface, an air system including a source of pressurized air, an air distribution assembly, and a controller to control the flow of air from the source of pressurized air through the air distribution system to the inflatable support structure, and a control system coupled to the deck, the control system including a circuit having an output for controlling movement of the deck to vary the position of the deck between the horizontal bed position and the chair egress position and for controlling the air system to control the inflation and deflation of the inflatable bladders, a processor in electrical communication with the circuit and operable to vary an output of the circuit, a memory device including instructions that when executed by the processor, cause the processor to control the circuit to vary the movement of the deck to vary the position of the deck between the horizontal bed position and the chair egress position, the control system coordinating the inflation of the inflatable bladders with movement of the deck between the horizontal bed position and chair egress position so that the inflatable bladders of the lumbar support section and seat support section inflate to the egress pressure as the patient support apparatus transitions to the chair egress position, and the inflatable bladder of the foot support section deflates to the egress pressure as the patient support apparatus transitions to the chair egress position.

2. The patient support apparatus of claim 1, wherein the inflatable support structure further includes a head egress bladder positioned in the head support section of the inflatable support structure, the head egress bladder being normally deflated and selectively inflated to assist the patient in egressing from a foot end of the deck of the patient support apparatus.

3. The patient support apparatus of claim 2, wherein the bladder positioned in the head support section is positioned in the area of the head support section that corresponds to the lumbar region of the patient's back.

4. The patient support apparatus of claim 3, wherein the inflatable support structure further includes a seat egress bladder positioned in the seat support section of the inflatable support structure, the seat egress bladder being normally deflated and selectively inflated to assist the patient in egressing from the foot end of the deck of the patient support apparatus.

5. The patient support apparatus of claim 1, wherein the inflatable support structure further includes a seat egress bladder positioned in the seat support section of the inflatable support structure, the seat egress bladder being normally deflated and selectively inflated to assist the patient in egressing from a foot end of the deck of the patient support apparatus.

6. The patient support apparatus of claim 1, wherein the inflatable support structure further includes a head egress bladder positioned in an area of the head support section of the inflatable support structure that corresponds to the lumbar area of a patient's back and a seat egress bladder, the head egress bladder and seat egress bladder each being normally deflated and each being independently selectively inflated to assist the patient in egressing from a foot end of the deck of the patient support apparatus.

7. The patient support apparatus of claim 6, wherein the control system includes a user interface and the user interface includes a first user input device that permits a user to selectively inflate the head egress bladder.

8. The patient support apparatus of claim 7, wherein the user interface includes a second user input device that permits the user to selectively inflate the seat egress bladder.

9. The patient support apparatus of claim 6, wherein the control system includes a user interface and the user interface includes a first user input device that permits a user to selectively inflate at least one of the head egress bladder and seat egress bladder.

10. The patient support apparatus of claim 9, wherein the control system detects the position of the deck of the patient support apparatus and does not inflate the head egress bladder or seat egress bladder if the patient support apparatus is not in the chair egress position.

11. A patient support apparatus comprising a deck including at least a head deck section, a seat deck section, and a foot deck section, the deck movable between a horizontal bed position for supporting a patient in a lying position to a chair egress position for supporting a patient in a sitting position, an inflatable support structure supported on the deck, the inflatable support structure including a first egress bladder and a second egress bladder, the first and second egress bladders each being inflatable from a support pressure when the deck is positioned in the horizontal bed position to an egress pressure when the deck is positioned in the chair egress position to enlarge a portion of the inflatable support structure to provide a convex support surface for the patient during egress from a foot end of the patient support apparatus, wherein the egress pressure is greater than the support pressure, an air system including a source of pressurized air, an air distribution assembly, and a controller to control the flow of air from the source of pressurized air through the air distribution system to the inflatable support structure, and a control system coupled to the deck, the control system including a circuit having an output for controlling movement of the deck to vary the position of the deck between the horizontal bed position and the chair egress position and for controlling the air system to control the inflation and deflation of the first and second egress bladders, a processor in electrical communication with the circuit and operable to vary an output of the circuit, a memory device including instructions that when executed by the processor, cause the processor to control the circuit to vary the movement of the deck to vary the position of the deck between the horizontal bed position and the chair egress position and coordinating the operation of the inflatable support structure with movement of the deck to cause the pressure in the first and second egress bladders to be increased to the respective egress pressures as the patient support apparatus is transitioned to the chair egress position.

12. The patient support apparatus of claim 11, wherein the foot deck section is movable to a generally vertical position when the deck is in the chair egress position and wherein the inflatable support structure includes at least one foot section bladder supporting a portion of the patient supported on the foot section, the control system deflating the foot section bladder when the deck is in the chair egress position.

13. The patient support apparatus of claim 12, wherein the control system includes a user interface including a plurality of user input devices that permit a user to selectively inflate the first and second egress bladders.

14. The patient support apparatus of claim 13, wherein the control system monitors the position of the deck section and prevents inflation of the egress bladders if the deck is not in the chair egress position.

15. The patient support apparatus of claim 11, wherein the first and second egress bladders are normally deflated.

16. The patient support apparatus of claim 11, wherein the first and second egress bladders are normally inflated to a support pressure and the control system is operable to increase the pressure to the egress pressure such that the bladders expand to the substantially convex support surface to support to a user who is egressing from the deck of the patient support apparatus.

17. The patient support apparatus of claim 16, wherein the first and second egress bladders are inflated when the patient support apparatus reaches the chair egress position.

18. The patient support apparatus of claim 17, wherein a user may actuate a user input device associated with a chair egress function and the control system moves the patient support apparatus to the chair egress position, selectively inflates the first and second egress bladder and selectively deflates other bladders in the inflatable support structure.

* * * * *